United States Patent [19]

Tafel

[11] Patent Number: 4,920,881

[45] Date of Patent: May 1, 1990

[54] METHOD OF COOLING HOT WEBS

[75] Inventor: Leonard I. Tafel, Wheeling, Ill.

[73] Assignee: Webquip Corporation, Wheeling, Ill.

[21] Appl. No.: 189,033

[22] Filed: May 2, 1988

[51] Int. Cl.[5] ..... B41F 23/04

[52] U.S. Cl. ..... 101/488; 101/424.1; 34/62; 165/90

[58] Field of Search ..... 101/416 A, 416 R, 488, 101/424.1; 34/62, 66, 67; 165/89, 90; 62/119; 118/59, 60

[56] References Cited

U.S. PATENT DOCUMENTS

| | | | |
|---|---|---|---|
| 3,580,003 | 5/1971 | Dolan | 62/119 X |
| 4,263,724 | 4/1981 | Vits | 34/62 |
| 4,377,936 | 3/1983 | Gram | 165/89 X |
| 4,462,169 | 7/1984 | Daane | 34/62 |
| 4,774,771 | 10/1988 | Littleton | 34/62 |

OTHER PUBLICATIONS

CRC Handbook of Chemistry and Physics, 66th Edition 1985-1986, CRC Press 1985, pp. E-31, E-32, E-33.

*Primary Examiner*—Edgar S. Burr
*Assistant Examiner*—Kimberly L. Asher
*Attorney, Agent, or Firm*—Gerstman & Ellis, Ltd.

[57] ABSTRACT

The method for cooling a hot web by passing it across a rotating thermally conductive chill roller having a circulating coolant therein. In accordance with this invention, one introduces as a coolant to the chill roller a liquid refrigerant at a temperature and pressure permitting the refrigerant to exist in liquid form, the temperature being also above the dew point of the ambient atmosphere. Likewise, the boiling point of the refrigerant at the desired temperature and pressure is low enough to cause heat to be absorbed by the chill roller substantially by vaporization of the liquid refrigerant. One then withdraws refrigerant vapor from the chill roller, and typically refrigerates it to reform the liquid phase for return to the chill roller. Typically, chlorofluorocarbon refrigerants are preferred.

7 Claims, 1 Drawing Sheet

FIG. 1
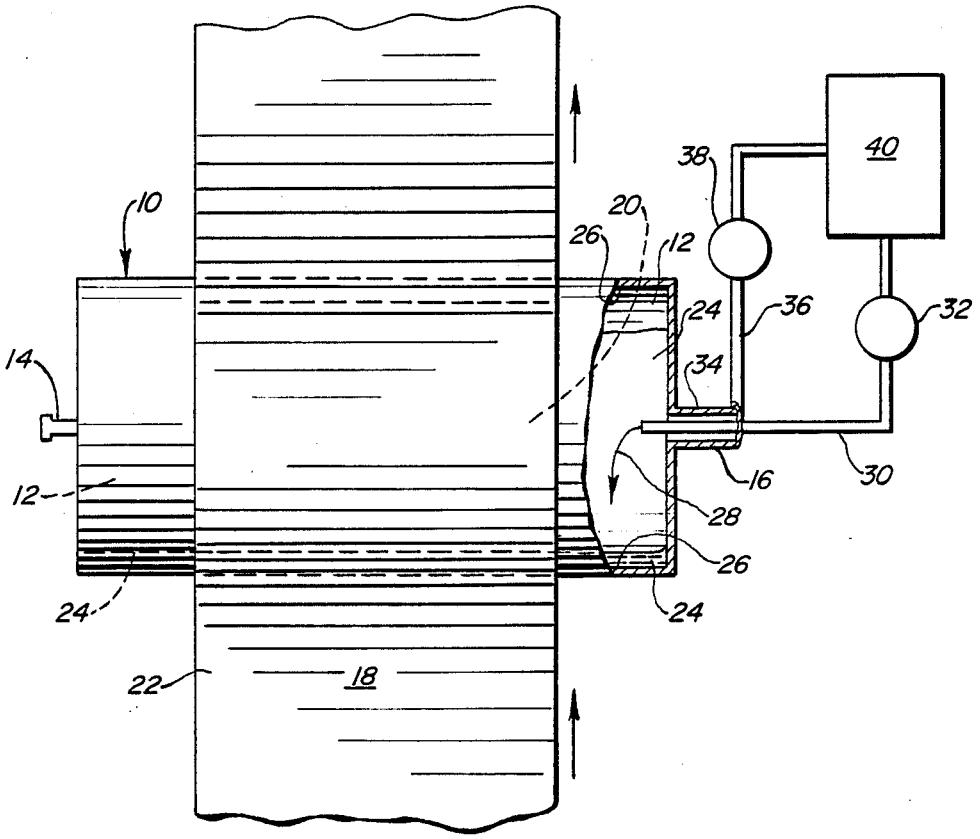
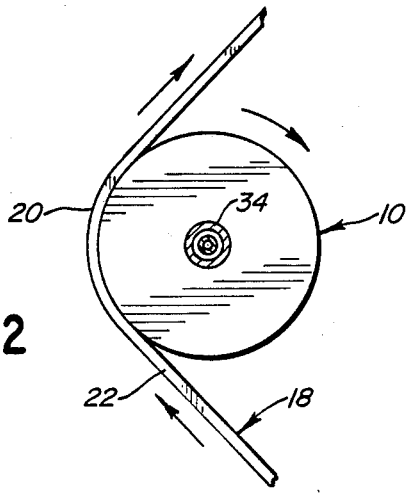
FIG. 2

METHOD OF COOLING HOT WEBS

BACKGROUND OF THE INVENTION

In newspaper printing processes and the like, the paper web with the print thereon is heated to fix the ink. The heating temperature is very high, close to the scorching temperature of the paper, so it is desirable to quickly chill the newsprint web after the ink has been appropriately heated Water cooled chill rollers are well known to the art. The water is first cooled by a refrigeration system, and is then pumped into the hollow chill roller, which is made of a conductive material such as steel or aluminum. Thus, the hot web passes across the rotating chill roller and is cooled, while the chill roller is cooled by the water (typically brine) present within the chill roller.

It has been found that this system exhibits some significant difficulties. First, the heat exchange between the water and the interior of the chill roller takes place by conduction and convection. Neither of these processes are fast, so it has been necessary to use quite cold water to provide adequate heat absorbing characteristics to the system. The problem is made worse by the fact that the water can deposit lime on the inside of the chill roller unless it has been deionized, which is of course an added expense. The lime deposit on the inner wall of the chill roller provides an insulating layer, which requires even colder water to be used. Because of the very cold water present in the roller, water condensation can take place in areas of the chill roller that the hot news print web does not contact. This is of course a great disadvantage, since the newsprint web disintegrates in the presence of water.

Also, if it is necessary to stop the rotation of the chill roller, it quickly cools down and begins to condense water or "sweat" over substantially all of its surface, which can result in that much faster disintegration of the newsprint web.

Accordingly, while prior art water cooled chill rollers are used for lack of a better system, they exhibit significant drawbacks and difficulties. By this invention, the above difficulties are reduced or eliminated.

DESCRIPTION OF THE INVENTION

In this invention, a method of cooling a hot web is provided by passing it across a rotating, thermally conductive chill roller having a circulating coolant therein, the coolant being a lower boiling material than water. In accordance with this invention, one introduces as a coolant to the chill roller a liquid refrigerant at a temperature and pressure permitting the refrigerant to exist in liquid form, the temperature being also normally above the dew point of the ambient atmosphere. The boiling point of the selected refrigerant at the specified temperature and pressure causes heat to be absorbed by the chill roller substantially by vaporization of the liquid refrigerant. Also, one withdraws refrigerant vapor from the chill roller to make room for the introduction of more coolant. Preferably, no more than half of the inner volume of the chill roller is filled with liquid refrigerant, so that adequate room for vapor is provided.

It is typically desirable for the withdrawn refrigerant vapor to be recompressed and cooled by conventional means to reform its liquid phase, followed by the step of returning the newly formed liquid refrigerant to the chill roller. Thus the refrigerant in its liquid and gas phases is recirculated.

The "dew point" of ambient atmosphere is a well-known term, being the highest temperature at which water vapor from the air condenses on surfaces such as an aluminum surface. It is a function of the relative humidity of the air and barometric pressure.

Because the refrigerant is normally introduced to the chill r at a temperature above the dew point of the ambient atmosphere outside of the roller, the chill roller can be stopped at any time during the printing process without water condensation appearing on its surface. The refrigerant selected for use has a boiling point at the desired pressure of use which causes the heat entering the chill roller from the hot web to be absorbed by the chill roller substantially by vaporization of the liquid refrigerant, making use of the latent heat of vaporization of the refrigerant. Typically, almost all of the incoming heat is absorbed by refrigerant vaporization rather than by simple heat exchange, as in water-cooled systems. Preferably, the selected temperature of the liquid refrigerant within the chill roller is about40° to 55° F. Materials such as commercially available chlorofluorocarbon refrigerants may be used, having boiling points which permit the absorption of heat by the chill roller substantially by vaporization of the liquid refrigerant.

This type of heat absorption turns out to be of substantially increased efficiency, when compared with simple conduction and convection-type heat absorption, particularly when the chill roller is rotating at a substantial rate as is customary, for example about 300 to 500 r.p.m. as the web passes across it. The centrifugal force of the rotation causes the liquid refrigerant to be forced outwardly into intimate contact with the inner walls of the chill roller. As vapor is formed through heat absorption, the vapor is rapidly displaced by more liquid refrigerant due to the centrifugal force applied to the system, so that refrigerant vapor is rapidly removed from contact with the inner surface and replaced by refrigerant liquid. The effect of this is a great increase in temperature absorption efficiency as mentioned above, so that the chill roller can effectively operate at a higher temperature than is typically possible with water-cooled chill rollers. Typically, the pressure under which the refrigerant liquid and vapor reside is about 50 to 150 psi., specifically 80 to 100 psi for a material such as DuPont refrigerant 12 or 22, which are of the chlorofluorocarbon type. Alternatively, a refrigerant such as sulfur dioxide may be used, if desired.

The chill roller used in this invention may desirably have a diameter of about 17 to 18 inches, so that as it rotates at about 300 to 500 r.p.m. it can provide the customary newsprint travel velocities for a conventional newsprint machine. The chill roller is preferably made of aluminum, or alternatively steel or another thermally conductive metal. The internal surface may be ribbed for greater heat transfer. The chill roller used in accordance with this invention exhibits a very low temperature gradient across its width, almost nonexistent, which solves another undesirable technical problem found in water-cooled chill rollers, where a significant temperature gradient across its width can exist. Additionally, less energy is required in pumping the recirculating refrigerant in accordance with this invention than is required for pumping an amount of cold water capable of equal heat absorption to the system of this invention. Also, lime deposit is eliminated.

As an added advantage, in the method of this invention there is more rapid control of the temperature. One can simply adjust the pressure within a chill roller in accordance with this invention to get immediate control of the temperature. To the contrary, in a water system, the temperature of the chill roller is much less easily and more slowly controlled.

DESCRIPTION OF THE DRAWING

In the drawing, FIG. 1 is a schematic view of a chill roller system in accordance with this invention, shown in the process of cooling a web of newsprint; and FIG. 2 is a side view of the system of FIG. 1.

DESCRIPTION OF SPECIFIC EMBODIMENT

Referring to FIG. 1, a chill roller 10 is shown defining a sealed, hollow cylinder having an inner chamber 12, and adapted to roll on pivots 14, 16 at a desired rate of rotation. Except as otherwise disclosed herein, chill roller 10 may be made in entirely conventional manner.

Chill roller 10 is positioned so that a hot web 18 of newsprint or the like, fresh from a dryer, can briefly pass across rotating chill roller 10 in engagement therewith at area 20, at which point heat from the hot web 18 is transferred to chill roller 10. At area 22 of web 18, prior to entering into contact with chill roller 10, the temperature of web 18 may be about 350° F.

Hot web 18 is moving rapidly across chill roller 10, typically at a speed of 1200 feet per minute or the like, and chill roller 10 is rotating so that its periphery is moving at a corresponding speed, so that abrasion of the web is minimized as web 18 passes across roller 10. While each individual, small area of web 18 is very thin, and thus carries little heat despite its high temperature at area 22, it can be seen that a substantial amount of heat is continuously being transferred to chill roller 10 because of the great speed with which web 18 may be passing across the roller.

The hollow interior 12 of chill roller 10 carries an amount of liquid refrigerant 24, for example a chlorofluorocarbon refrigerant such as DuPont Freon refrigerant 12 or 22. Because of the rapid rotation of chill roller 10, refrigerant 24 is pressed against inner wall 26 of roller 10, thus occupying at least substantial portion of the inner wall area. The rapid rotation of chill roller 10 at, for example 350 r.p.m., insures that a large interior area of the chill roller, and preferably all of it, is in heat exchange contact with the refrigerant liquid. The refrigerant liquid may be at a temperature of, for example, 50° F., and at a pressure of about 90 psi.

The refrigerant is constantly boiling as heat from web 18 is absorbed by chill roller 10. As previously stated, this efficient form of heat absorption permits operation of the chill roller at a significantly higher temperature than water-cooled chill rollers, above the dew point of the ambient atmosphere in virtually all circumstances, so that the problem of water condensation on the chill roller is avoided, while at the same time chill roller remains fully capable of cooling web 18 down to a desired temperature. For example, chill roller 10 can stop rotating, but it will not cool down below the temperature of incoming refrigerant 28, so that water condensation on roller 10 can be avoided.

Liquid refrigerant 28 is constantly being introduced into chamber 12 of the chill roller, through line 30 which enters axially through pivot 16. The pressure of the system may be controlled by pump 32 in conjunction with pump 38.

At the same time, refrigerant vapor is being constantly withdrawn through outlet 34, and through line 36 which leads to compression pump 38. The compressed refrigerant vapor then passes to a refrigerator 40 where it is cooled and liquefied to its desired operating temperature, from where it is once again pumped by pump 32 into line 30 for recirculation to the interior of chill roller 10.

Thus an improved chill roller is provided in accordance with this invention, capable of operating above the dew point of the usual ambient atmosphere so that condensation does not appear on the roller, and capable of improved temperature control and heat absorption when compared with prior art chill rollers.

The above has been offered for illustrative purposes only, and is not intended to limit the scope of the invention of this application, which is as defined in the claims below.

That which is claimed is:

1. A method for cooling a hot web which comprises the steps of:

providing a thermally conductive chill roller;

introducing to said chill roller a liquid refrigerant, at a temperature and pressure permitting said refrigerant to exist in liquid form, said temperature being also above the dew point of the ambient atmosphere, the boiling point of said refrigerant at said temperature and pressure causing heat to be absorbed by said chill roller in response to said vaporization of liquid refrigerant;

rotating said chill roller;

vaporizing said liquid refrigerant by passing said hot web across said rotating chill roller having said refrigerant therein; and withdrawing refrigerant vapor from said chill roller.

2. A method as defined in claim 1, including the steps of cooling said vapor to reform the liquid phase; and returning the refrigerant in liquid form to said chill roller.

3. The method of claim 1 in which said temperature is about 40° to 55°.

4. The method of claim 1 in which said pressure is about 50 to 150 psi.

5. The method of claim 1 in which said chill roller has a diameter of about 17 to 18 inches.

6. The method of claim 1 in which said chill roller rotates at about 300 to 500 r.p.m. as said web passes across it.

7. The method of claim 1 in which said hot web has a temperature of about 300° to 400° F. as it enters into contact with said chill roller.

* * * * *